United States Patent [19]

Knecht

[11] Patent Number: 4,483,489

[45] Date of Patent: Nov. 20, 1984

[54] DEVICE FOR THE AUTOMATIC ANCHORING OF THE OUTER YARN END OF BALLS IN AUTOMATIC BALLING MACHINES

[75] Inventor: Rudolf Knecht, Kollbrunn, Switzerland

[73] Assignee: G & W Maschinen AG, Wetzikon, Switzerland

[21] Appl. No.: 382,585

[22] Filed: May 27, 1982

[30] Foreign Application Priority Data

Jun. 5, 1981 [CH] Switzerland ..... 3699/81

[51] Int. Cl.[3] ..... B65H 54/64; B65H 75/24

[52] U.S. Cl. ..... 242/2; 242/110.1

[58] Field of Search ..... 242/2, 47, 53; 156/186, 156/429, 445, 170

[56] References Cited

U.S. PATENT DOCUMENTS

| | | | |
|---|---|---|---|
| 4,124,171 | 11/1978 | Lucke | 242/2 |
| 4,300,727 | 11/1981 | Koch et al. | 242/2 |

FOREIGN PATENT DOCUMENTS

| | | | |
|---|---|---|---|
| 2513144 | 2/1978 | Fed. Rep. of Germany . | |
| 3023040 | 1/1982 | Fed. Rep. of Germany | 242/2 |
| 1057920 | 3/1954 | France . | |
| 282330 | 4/1952 | Switzerland | 242/2 |

*Primary Examiner*—Stuart S. Levy
*Assistant Examiner*—Thomas R. Hannon
*Attorney, Agent, or Firm*—Murray Schaffer

[57] ABSTRACT

A winding mandrel for a ball winding machine has umbrella stretchers at its forward portion on which yarn is wound. The front end of the mandrel is provided with a plurality of radial channels open on frontal edged for receiving a yarn and retaining means movable with respect to the front end to occlude at least one of the radial channels to hold the yarn in the channel.

5 Claims, 5 Drawing Figures

DEVICE FOR THE AUTOMATIC ANCHORING OF THE OUTER YARN END OF BALLS IN AUTOMATIC BALLING MACHINES

BACKGROUND OF THE INVENTION

The present invention relates to a device for automatically anchoring the outer thread end of a ball wound on an automatic balling machine. The invention relates further to a process for operating the balling machine pursuant to the invention, whereby the lapping thread is guided in front of the front end of the winding mandrel after termination of the lapping process.

Devices and processes for the automatic anchoring of the outer thread end of balls are known to the art from the German patent specification No. 2,513,144 and from the French patent specification No. 1,057,920. The German patent specification No. 2,513,144 discloses an umbrella mandrel for known automatic balling machines, which machines can be equipped with a number of winding mandrels arranged horizontally or diagonally as spindles. A rotating winding arm, a cutting device, a thread guide, and gripping devices for pulling the ball off the winding mandrels are assigned to each winding mandrel. In this device, the thread is guided after the termination of the lapping process by the winding arm and the thread guide in front of the front end of the winding mandrel, cut by the cutting device, and the thread end sucked into a suction tube arranged inside of the mandrel and thereby held fast or anchored. The suction tube extends over the entire length of the winding mandrel and is at the same time designed as a push rod for the actuation of the umbrella stretchers of the umbrella mandrel. Located at the rear end of the suction tube is a connection to a vacuum pump which provides the suction necessary for anchoring the thread end. A high suction output of the vacuum pump is required for this method of securing the thread end. The energy required for the generation of the suction stream in the suction tube can thereby be substantially greater than the energy required for driving the winding mandrel. Depending on the thickness and type of thread, the end of the thread can be sucked more or less effectively into the suction tube, resulting in considerable differences in the work flow and operation of the winding device. This necessitates frequent adjusting of the winding device to the various yarn and/or thread types, or else malfunctions in the machinery will occur which lead to undesirable disruption in the operation.

The French patent specification No. 1,057,920 shows also an umbrella mandrel with a winding arm and cutting device. The cut end of the thread is secured in this device by inserting the lapping thread through the winding arm into a hook provided at the front end of the winding mandrel. This hook is pulled with the inserted end of the thread by a drawbar into the inner cavity of the core of the winding mandrel which is fashioned as a tube. The thread is thereby anchored and pulled into the interior of the ball when the latter is pulled off the umbrella mandrel. The disadvantage in this device is that the lapping thread can become caught in the hook, with the result that the ball cannot be completely pulled off. In addition, fibers of the lapping thread remain hanging on the hook, with the result that the insertion of the lapping thread into the hook is prevented after a certain period of operation and the anchoring of the thread end becomes impossible. Prior to cutting the thread, the winding arm, winding mandrel and cutting device must be brought into an exactly predetermined position, so that the lapping thread can be inserted into the hook and also remains there.

The present invention has the task of avoiding the disadvantages present in the known state of the art and of presenting a solution which does not require additional driving power for anchoring of the thread, and whereby the thread can be anchored in any desired position after having been guided over the front end of the winding mandrel. The invention also should make it possible to treat every thickness and type of thread the same.

SUMMARY OF THE INVENTION

The present invention solves the foregoing tasks by forming on the front end of the winding mandrel at least one channel extending in a plane perpendicular to the longitudinal axis of the mandrel into which a thread may be received and retained. To effect retention a locking cap is mounted on the front end of the mandrel provided with at least one groove open on the frontal surface and to the side edges and a locking crown movable with respect to the locking cap into a position to cover at least partially the frontal opening of the groove and thus secure the thread therein.

Preferably, at least three channels are provided in the locking cap on the front end of the mandrel spaced radially from the longitudinal central axis of the mandrel. The locking crown comprises a annular member surrounding the cap and is provided with a number of openings corresponding to the number of openings in the cap. The crown is rotatable about the cap between a first position in registry with the openings in the cap and a second position occluding the openings and thus retaining the thread within the groove of the cap.

Preferably, the locking crown is mounted at the end of a rod, extending through the center of the mandrel and rotatable about the central axis. The thread channels in the crown are preferably provided with varying dimensions in the direction of the longitudinal axis of the winding mandrel. They have the same width in the forward-most part as the thread channels in the mandrel and are at least twice as wide at the base. The crown and the rotary axle are furthermore swivable about the central axis by at least that angle which is formed by the axially extending side surfaces of a thread channel.

Additional advantages result from the use of the present invention in umbrella mandrels having a push rod capable of sliding in a known manner lengthwise inside the mandrel for the purpose of opening and closing the umbrella stretchers. This can be easily effected by arranging the rotary axle on the inside of the push rod and by encasing the push rod in a rotary guide which is firmly attached to a sleeve and a guide hub of the winding mandrel and rotates together with the entire winding mandrel. A guide-way, engaged by a cam attached to the rotary axle, is arranged in the rotary guide. The cam passes through the wall of the push rod, whereby this penetration of the push rod wall in the direction of the circumference of the latter has the shape of an oblong hole, with the opening therefor bigger than the cam diameter. When the push rod moves in the longitudinal direction of the winding mandrel inside of the guide hub, the cam slides in the arched guide-way of the rotary guide, thereby rotating the rotary axle in relation to the push rod.

The operation of the device pursuant to the invention is distinguished by the fact that a thread channel is formed during the winding process by registery of each of the locking crown and the closing cap. After the insertion of the thread into one of these common thread channels, the ball formed on the mandrel is released, while the rotary axle supporting the crown is rotated. Thus, the locking portion of the crown is pushed in front of the openings on the closing cap retaining the thread. The thread is then cut. The ball is then pulled off the mandrel, causing the secured end of the thread to be tucked into the ball and to be subsequently pulled out from the thread channel through the circumferential opening.

It is of advantage to use a mandrel where the umbrella stretchers are opened and closed by a push rod which is axially movable in the winding mandrel, so that rotary axle can easily swivel it at the same time in relation to the push rod. This results in the automatic turning of the crown with respect to the closing cap and the locking in registry of the channel openings.

The advantages obtained by the invention are seen in the fact that aside from the drive for the winding mandrel and the winding arm no additional drive or energy consumer is needed for anchoring the thread end. The lapping process can be interrupted in any desired position and the thread with the thread guide can be moved in front of the front end of the winding mandrel and be secured there. A fixation of the holding position of the mandrel and of the winding arm is unnecessary, resulting in a substantial simplification of the operation. The arrangement and design of the thread channels of the locking crown and closing cap can be varied widely and be adapted to the varying operating conditions. Threads having different diameters and slubs, as well as roughened or nonroughened yarns can be fixed in position or held fast with the same device without change or disruption in operation.

Additional details and features of the invention are explained in greater detail below with the aid of drawings which merely represent an embodiment.

DESCRIPTION OF THE INVENTION

Figure 1:
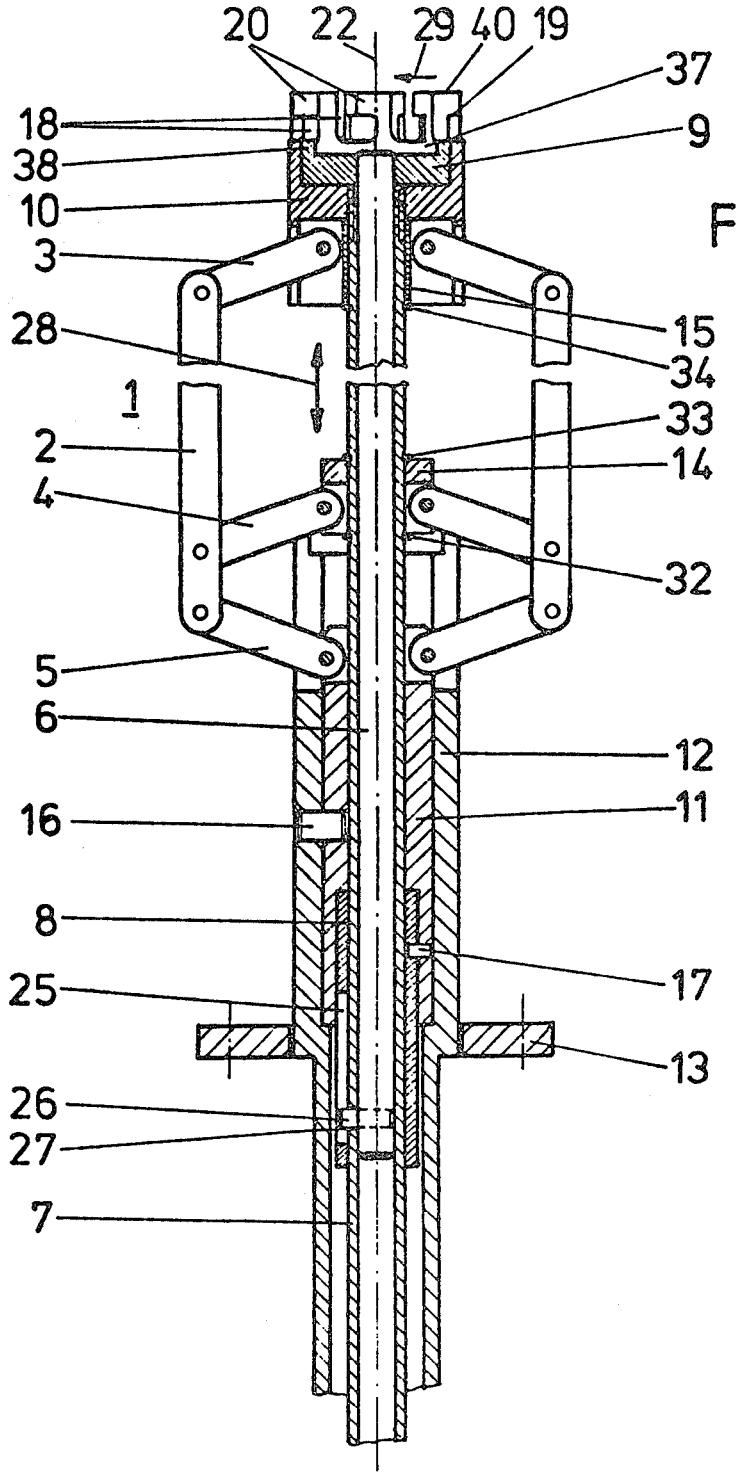
FIG. 1 is a longitudinal cross section of an umbrella mandrel with the anchoring device pursuant to the invention.

The umbrella mandrel 1 illustrated in FIG. 1 consists of an outer sleeve 12 mounted about a guide hub 11, to which longitudinal stretchers 2 and lateral stretchers 3, 4 and 5 are linked. The sleeve 12 is connected by way of a geared flange 13 with a bearing and drive unit not shown in the drawing. The entire winding mandrel 1 can be rotated by way of this drive and bearing unit, and thus a thread can be lapped or wound on the stretchers 2, 3 and 5. A tube-shaped push rod 7, extending through the entire length of the winding mandrel, is arranged inside the mandrel 1. The push rod 7 can be moved back and forth within the guide hub 11 in the direction of the arrow 28 along the longitudinal axis 22. The push rod 7 is actuated by an auxiliary mechanism located at the rear end of the winding mandrel 1 which is also not shown in the drawing. Arranged on the push rod 7 are stretcher holders 14, 15, held in their respective positions by locking rings 32, 33 & 34. The longitudinal stretches 2 are connected to the guide hub 11 and the holders 14, 15 by way of the lateral stretchers 3, 4, and 5. By moving the push rod 7 in the direction of the arrow 28, the stretcher holders 14, 15 are moved by the guide hub away from or toward the latter, resulting in the radial opening and closing of the umbrella stretchers 2.

Figure 2:
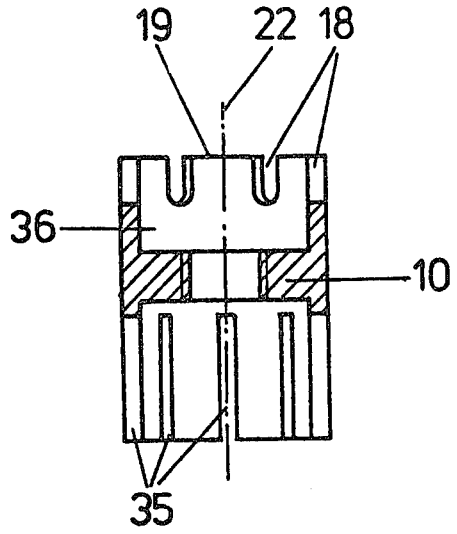
FIG. 2 is an enlarged view of the closing cap of the anchoring device, removed from the mandrel.
Figure 3:
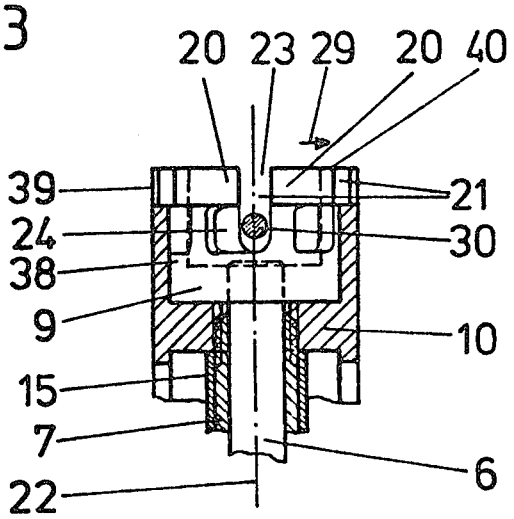
FIG. 3 is an enlarged section through the front end of a winding mandrel showing the anchoring device with an inserted thread end.

Fixedly mounted on the push rod 7 is a cylindrical closing cap 10 shown in detail in FIG. 2. The front edge 19 of the closing cap 10 forms the front surface of the mandrel 1, while the cap is provided in its rear area with guide slots 35 for the lateral stretchers 3. The circumferential wall of the cap is formed with a plurality of uniformly spaced radial grooves 18 aligned to form thread receiving channels extending transverse to the longitudinal axis 22 of the mandrel. The grooves 18 are open to the front surface edge 19. Six grooves are illustrated, providing three thread channels, in the example. A cylindrical locking crown 9 is arranged coaxially in the cavity 36 of the closing cap 10. As illustrated in FIG. 3, the locking crown 9 has a bottom end wall fixed to the end of a rotatable axle 6 extending through the push rod 7 and the locking cap 10. The locking crown 9 defines an inner cavity 37 with its cylindrical wall 38 and is formed with a radially enlarged collar 39 at its front end. The collar 39 overlaps the edge 19 of the cap 10 and has the same outer diameter as that of the closing cap 10. The locking crown 9 is also provided with a plurality of uniformly spaced grooves 21 formed in the cylindrical wall 38 and in the collar 39. The grooves 21 extend in the direction of the longitudinal axis 22 and are open at their front ends. The number of grooves 21 conform to the number of grooves 18 in the closing cap 10. The circumferential width of the grooves 21 in their axially front portion 23 (i.e. in the collar 39) is the same as that of the grooves 18, however, the width of the axially rear portion 24 (lying behind the collar 39) is at least double that of the grooves 18 in the closing cap 10. As a result, the cylindrical wall of the locking crown is provided with overhanging locking parts 20 formed on the collar 39 forming an L-shaped opening, which when the crown is rotated will close off the groove 18 in the cap 10. The full opening width of the channel remains nevertheless intact (i.e. free) through the widened axially rear portion 24 even when rotated to the occulding position. The overhanging locking parts 20 are rounded off and bevelled on all sides in the area of their frontal surface 40, so that the thread 30 stretched over the frontal surface 40 will slide in any case into a channel formed by a pair of aligned grooves 18 & 21.

As illustrated in FIGS. 1 and 3, the rotary axle 6 is arranged in the center of the push rod 7 and extends to the rear area of the guide hub 11, where a rotary guide 8 is firmly connected with the guide hub 11 by way of the connection pin 17 enclosing the push rod 7.

Figure 5:
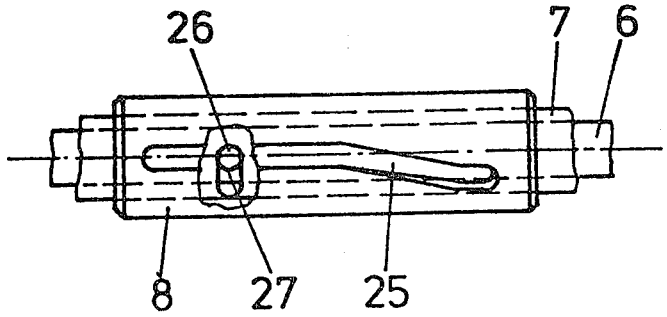
FIG. 5 is a side view of a rotary guide showing the guide-way and the rotary axle cam for operation of the anchoring device.

As illustrated in FIGS. 1 and 5, a curved guide-way 25 is formed into the wall of the rotary guide 8 and a cam 26 is firmly attached to the rear end of the rotary axle 6 to slidably enter in this guide-way 25 through an opening 27 in the wall of the push rod 7. The opening 27 has the shape of an oblong hole transverse to the longitudinal axis and is designed in such a way that it permits the cam 26 to execute the desired swivel motion when it moves in the guide-way 25. By shifting the push rod 7 in the direction of the arrow 28, the cam 26 slides in the guide-way 25, and the rotary axle 6 and the locking crown 9 attached firmly to it are swiveled in the direction of the arrow 29. The push rod 7, however, remains thereby in its position, since it is fixed in place with respect to the guide hub 11 and the sleeve 12 by way of the closing cap 10 and the stretchers 2, 3, 4, and 5. The guide hub 11 and the sleeve 12 are firmly joined to each other by means of a connection pin 16.

As seen, the locking crown with the collar 39 seated at the end of the fixed closing cap, is thus rotatable relative to the cap from a first position where the end openings of grooves 18 and 21 are in registry, permitting entry of a thread 30 into a channel, to a second position wherein the overhanging parts 29 are shifted to occlude the groove 18, thus closing the channel and retaining the thread.

Figure 4:
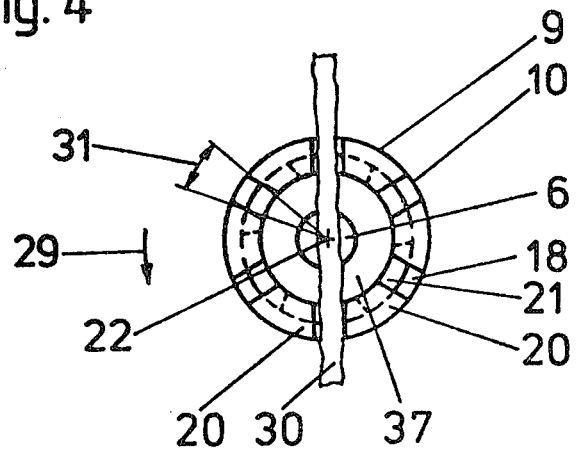
FIG. 4 is a front elevational view of the mandrel showing a thread in the anchoring device.

After termination of the winding process the thread end 30 is anchored, by being guided via a thread guide not shown, and laid over the front end of the winding mandrel 1. During winding and at least at the end of the winding operation at least one groove 18 of the closing cap 10 and one groove 21 of the locking crown 9 are aligned with each other forming a common thread channel so that when the thread 30 is placed over the front end of the winding mandrel 1, it automatically slides into this common thread channel and is located, as is evident from FIG. 3, beneath the collar 39 of the locking crown 9. Thereafter the push rod 7 is moved forward inside the winding mandrel 1, and the umbrella stretchers 2, 3, 4, and 5 are closed to release the wound ball. Simultaneously, the rotary axle 6 is pushed forward and the cam 26 glides in the guide-way 25. As a result, the rotary axle 6 and the locking crown 9 are swiveled about the angle 31 shown in FIG. 4, and the overhanging locking part 20 of the locking crown 9 is pushed in front of the apertures of the thread channels 18. As a result, the thread end 30 is firmly anchored in the groove 18 within the axially rear part 24 of the groove 21. The lapped ball can now be pulled off the winding mandrel 1 in the forward direction. The thread end 30 secured in the grooves 18, 21 is at first pulled into the interior of the ball and is then pulled radially out of the grooves 18 and 21 during further pulling of the ball from the winding mandrel 1. Prior to the next lapping process, the push rod 7 is retracted by being pulled back again into the winding mandrel 1, with the result that the rotary axle 6 and the locking crown 9 are swiveled back in the direction opposite to that of the arrow 29 and the openings of the grooves 18 are unblocked again.

I claim:

1. Apparatus for anchoring the terminal thread end of a ball wound on an automatic winding machine having a winding mandrel mounted at its rear end for rotation about its central axis, and stretcher means at its frontal end on which said thread is wound, said apparatus comprising a plurality of open channels formed on the frontal surface of the forward end of the mandrel for receiving the thread, said channels extending radially perpendicular to the central axis, and retaining means rotatable with respect to the frontal end of said mandrel between a first position in which at least a part of at least one of said channels is open frontally and a second position in which said at least one of said channels is frontally occluded whereby a thread may be received and retained in said at least one of said channels.

2. The apparatus according to claim 1 wherein said radial channels are formed in an annular cap and said retaining means comprises an annular crown mounted for rotation about the central axis of said mandrel in association with said cap, said crown having at least one slot having one leg extending circumferentially and another leg axially of said crown, said axial leg having a width corresponding to the width of the channel in said cap and the circumferential leg having a width at least twice as wide as said channels.

3. The apparatus according to claim 2, wherein said cap comprises a cylindrical member closed at its bottom end and said channels are formed in the circumferential wall thereof, and said crown is arranged within said cylindrical member, and said slots are formed on the cylindrical wall thereof, and an axle secured to the bottom of said crown and extending through said mandrel and means for swiveling said axle about its longitudinal axis.

4. The apparatus according to claim 3 wherein said axle is swivable in at least an angle formed by the lateral edges of said channels with a center lying in the longitudinal axis of the mandrel.

5. The apparatus according to claim 4 wherein said mandrel includes a push rod movable in a longitudinal direction for the opening and closing of the stretchers and said axle extends through said push rod, a rotary guide having an arc-shaped guide-way arranged about said axle, said rotary guide being connected with a gear hub and the sleeve for rotating said mandrel, a cam arranged on the rotary axle engaging said guideway, said cam being guided through an opening in the wall of the push rod which is larger in the circumferential direction than the cam diameter.

* * * * *